US006417877B2

(12) United States Patent
Oishi

(10) Patent No.: US 6,417,877 B2
(45) Date of Patent: Jul. 9, 2002

(54) CURRENT SUPPLY CONTROL METHOD FOR LINE THERMAL HEAD

(75) Inventor: Yuki Oishi, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/785,735

(22) Filed: Feb. 16, 2001

(30) Foreign Application Priority Data

Feb. 21, 2000 (JP) ..... 2000-042363

(51) Int. Cl.[7] ..... B41J 2/355; B41J 2/35
(52) U.S. Cl. ..... 347/182
(58) Field of Search ..... 347/180, 182; 400/120.05, 120.06

(56) References Cited

U.S. PATENT DOCUMENTS 5,075,701 A * 12/1991 Arai ..... 347/182
5,157,761 A 10/1992 Hawkes

FOREIGN PATENT DOCUMENTS

EP 0 478 369 A2 4/1992

* cited by examiner

*Primary Examiner*—Huan Tran
(74) *Attorney, Agent, or Firm*—Brinks Hofer Gilson & Lione

(57) ABSTRACT

The invention provides a current supply control method used for a line thermal head that is capable of reducing the irregular color and jitter easily and surely. The method is characterized in that heating elements served for divided driving are controlled so as to be different for each color served for printing.

3 Claims, 2 Drawing Sheets

CURRENT SUPPLY CONTROL METHOD FOR LINE THERMAL HEAD

BACKGROUND OF THE INVENTION

1. Field of the Invention

This invention relates to a current supply control method for a line thermal head, and more particularly relates to a current supply control method for a line thermal head that is preferably used for color printing.

2. Description of the Related Art

Heretofore, a thermal transfer line printer has been known, in which a line thermal head having a sufficient length for facing to the printing range in a vertical direction or a horizontal direction of a paper is pressed on a platen roller with interposition of an ink film such as ink ribbon or ink sheet and a paper, the platen roller is driven rotationally in a pressed state, a plurality of heating elements of the line thermal head are driven and heated selectively based on printing information while the ink film and the paper are being moved, and ink of the ink film is thereby transferred and printed on the paper.

In the case that a thermal transfer line printer as described hereinabove is used for color printing, a color ink film that is called multicolor ink film on which at least three color inks of three primary colors, namely Y (yellow), M (magenta), and C (cyan) are disposed repeatedly along a moving direction of a paper is used for color printing. In detail, at first Y ink of the color ink film is printed on the paper over one page (one screen), subsequently a paper that has been moved forward in printing operation is moved backward to align a head of the paper at the printing position, a head of M ink of the color ink film is searched next and M ink of the color ink film is printed on the paper over the one page (one screen), and C ink of the color ink film is printed on the paper in the same manner. Thus, three color inks, namely Y, M, and C, are printed one on another on the paper for color printing.

A line thermal head has a plurality of heating elements arranged in a direction perpendicular to the moving direction of a paper and the number of heating elements is as many as, for example, about 500. As the result, if a current supply control method in which a current is supplied to all the heating elements simultaneously is employed, then the driving circuit is inevitably large and the supply current is also inevitably large to result in difficulty in battery driving. The method as described hereinabove is involved in various problems.

To solve the above-mentioned problems, another current supply control method is used, in which heating elements are divided into groups by grouping with some heating element intervals and a current is supplied to a group at a time so that the number of heating elements to be heated at a time is reduced in order to reduce the magnitude of the current and to miniaturize the driving circuit. Thus, a battery having a small power source capacity can be used for driving.

For example, in the case of 5-divided driving in which a current is supplied to heating elements HD for one line printing, a plurality of heating elements HD arranged in a printing line direction are numbered from a left end, which is the reference, to a right end with numbers 1, 2, 3, 4, 5, 6, . . . in square frames as shown in FIG. 4, a current is supplied to the heating element HD at the left end and heating elements HD positioned at intervals of five heating elements HD from that HD at the left end (heating element numbers 1, 6, 11, . . . ) at first time for driving (current supply order number 1 is given to these heating elements HD in FIG. 4), and a current is supplied to the second heating element HD positioned rightward next to the left end heating element HD and heating elements HD positioned at intervals of five heating elements HD from the second heating element HD (heating element numbers 2, 7, 12, . . . ) at second time for driving (current supply order number 2 is given to these heating elements HD in FIG. 4). Next, a current is supplied to the heating element HD positioned at the third position from the left end in the right direction and heating elements HD positioned at intervals of five heating elements HD from the third heating element HD (heating element numbers 3, 8, 13, . . . ) at third time for driving (current supply order number 3 is given to these heating elements HD in FIG. 4), and a current is supplied to the heating element HD positioned at the fourth position from the left end in the right direction and heating elements HD positioned at intervals of five heating elements HD from the fourth heating element HD (heating element numbers 4, 9, 14, . . . ) at fourth time for driving (current supply order number 4 is given to these heating elements in FIG. 4). Finally, a current is supplied to the heating element HD positioned at the fifth position from the left end in the right direction and heating elements HD positioned at intervals of five heating elements from the fifth heating element HD (heating element numbers 5, 10, 15, . . . ) at fifth time for driving (current supply order number 5 is given to these heating elements HD in FIG. 4). When the next line is to be printed, the heating elements that have been driven at first time (heating element number 1, 6, 11, . . . ) are driven at first again, and other heating elements HD are driven successively in the same manner as described above.

Furthermore, in printing in the case of 5-divided driving, as shown in FIG. 5, a head position of a printing dot PD of the current supply order numbers 1, 2, 3, 4, and 5 is positioned in parallel in a line direction and is displaced by ⅕ one printing dot PD every current supply order number.

Furthermore, the current supply order to the heating element HD is set independently of the ink color, and printing dots of YPD, MPD, and CPD of three color inks Y, M, and C are formed on the same positions, in detail, positions of the current supply order numbers of 1, 2, 3, 4, and 5 in FIG. 5.

However, in the case of the conventional current supply control method described above, the current supply order to the heating element HD is set independently of ink color, that is, the current supply order is set so that the position of the heating element HD to be served for divided driving is independent of the color served for printing. Therefore, to print printing dots YPD, MPD, and CPD of three colors Y, M, and C on the same position on a paper, for example, the printing position accuracy that is so high as positional deviation of a paper that occurs when each color is printed is equal to or less than 5 $\mu$m is required in the case of a 300 dpi line thermal head. The reason is that, for example, if the printing position of a printing dot CPD deviates from the printing position of the printing dots YPD and MPD formed by printing Y color ink and M color ink due to the positional deviation of the paper that occurs when C color ink is printed, then the printing position of C color printing dots CPD deviates on all the positions of the current supply order numbers 1, 2, 3, 4, and 5, and the hue tends toward C color as a whole and it tends to cause irregular color and jitter.

Therefore, the conventional current supply control method is involved in the problem that the high mechanism accuracy for supplying a paper with high accuracy is required in order to obtain high printing quality with less irregular color and jitter that associate with the paper feeding accuracy.

To solve such problem, a current supply control method that is capable of easily reducing irregular color and jitter due to the paper feeding accuracy has been expected to be developed.

SUMMARY OF THE INVENTION

The present invention has been accomplished in view of these points, it is an object of the present invention to provide a current supply control method used for a line thermal head that is capable of reducing irregular color and jitter easily and surely.

To achieve the above-mentioned object, a current supply control method used for a line thermal head in accordance with the present invention is characterized in that the heating element to be served for divided driving is controlled so as to be different for each color to be printed. Because each heating element is served for printing correspondingly to the number of divisions and the printing position of the printing dot of each color is formed at the position with deviation by employing the structure described above, the irregular color and jitter due to deviation of paper feeding position are made unremarkable. Therefore, the adverse effect of deviation of paper feeding position is mitigated, and the irregular color and jitter due to the paper feeding accuracy is reduced easily.

The current supply control method used for a line thermal head in accordance with the present invention is characterized in that the number of divisions of the divided driving is an odd number. The number of divisions that is suitable for easily reducing the irregular color and jitter due to the paper feeding accuracy is obtained by employing the structure described above.

Furthermore, the current supplying control method used for a line thermal head in accordance with the present invention is characterized in that the number of divisions of the divided driving is 5. The number of divisions that is suitable for easily reducing the irregular color and jitter due to the paper feeding accuracy is obtained by employing the structure described above.

DETAILED DESCRIPTION OF THE PREFERRED EMBODIMENTS

Embodiments of the present invention will be described in detail hereinafter with reference to the drawings.

Figure 1:
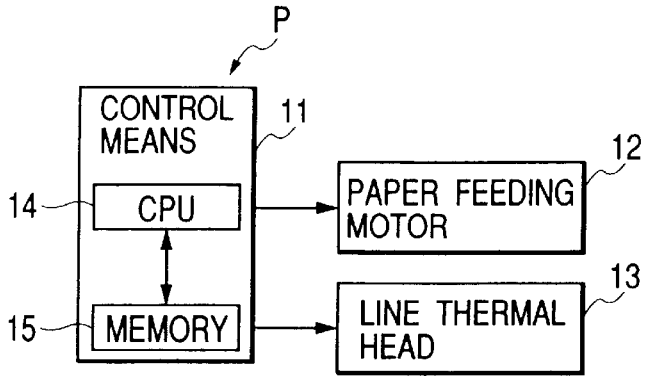
FIG. 1 is a block diagram partially illustrating a thermal transfer line printer to which a current supply control method used for a line thermal head in accordance with the present invention is applied.

FIG. 1 is a block diagram partially illustrating a thermal transfer line printer to which a current supply control method used for a line thermal head in accordance with the present invention is applied.

As shown in FIG. 1, the thermal transfer line printer P of the present embodiment is provided with a control means 11 for controlling the operation of components, and a paper feeding motor 12 that is a driving source of a paper feeding mechanism also served as a driving source of a color ink film running means not shown in the drawing, and a line thermal head 13 are connected electrically to the control means 11 through an exclusive driving driver not shown in the drawing.

The control means 11 has at least a CPU 14 and a memory 15 comprising a ROM or RAM with a suitable capacity. The memory 15 of the present embodiment has a stored program for at least dividing the current supplied to each heating element HD with intervals of 5 heating elements HD for 5-divided driving and for controlling the position of the heating element HD served for divided driving so as to be different for each color served for printing. Furthermore, various programs such as a program for controlling the operation and operation sequence of each component and a program for initialization operation executed when a power source is turned on, and various data such as the data that is necessary for printing operation are stored in the memory 15 of the present embodiment.

The structure of each component that constitutes the thermal transfer line printer P is the same as that of the conventional thermal transfer line printer, and the detailed description is omitted.

Next, the operation of the present embodiment comprising the above-mentioned components will be described along with the current supply control method.

The current supply control method for supplying a current to each heating element of the line thermal head 13 of the thermal transfer line printer P of the present embodiment controls the operation so that the current supply to each heating element HD of the line thermal head 13 is divided with intervals of 5 heating elements HD for forming 5-divided driving, and the heating element HD served for divided driving is different for each color.

Figure 2:
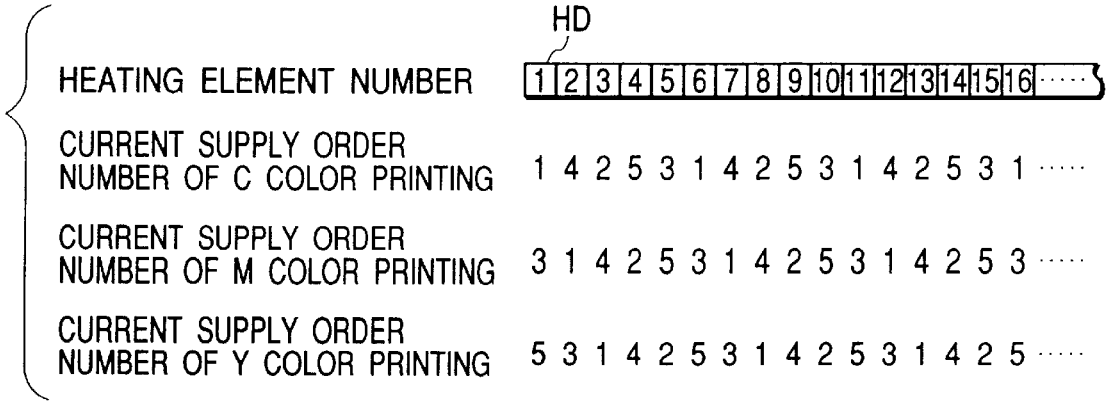
FIG. 2 is an explanatory diagram for describing the driving order of heating elements based on the current supply control method used for a line thermal head in accordance with the present invention.

For example, as shown in FIG. 2, it is assumed that a plurality of heating elements HD arranged in the printing line direction are numbered from the left end, which is the, reference, to the right end with numbers 1, 2, 3, 4, 5, 6, . . . in square frames as shown in FIG. 2. In the case that C color ink is printed, a current is supplied to the left end heating element HD and heating elements HD positioned at intervals of five heating elements HD from the left end heating element HD (heating element numbers 1, 6, 11, . . . ) at first time for driving (current supply order number 1 is given to these heating elements HD in FIG. 2), and a current is supplied to the third heating element HD positioned rightward next to the left end heating element HD and heating elements HD positioned at intervals of five heating elements HD from the third heating element HD (heating element numbers 3, 8, 13, . . . ) at second time for driving (current supply order number 2 is given to these heating elements HD in FIG. 2). Next, a current is supplied to the heating element HD positioned at the fifth position from the left end in the right direction and heating elements HD positioned at intervals of five heating elements HD from the fifth heating element HD (heating element numbers 5 10, 15, . . . ) at third time for driving (current supply order number 3 is given to these heating elements HD in FIG. 2), and a current is supplied to the heating element HD positioned at the second position, from the left end in the right direction and heating elements HD positioned at intervals of five heating elements HD from the second heating element HD (heating element numbers 2, 7, 12, . . . ) at fourth time for driving (current supply order number 4 is given to these heating elements in FIG. 2). Finally, a current is supplied to the heating element HD positioned at the fourth position from the left end in the right direction and heating elements HD positioned at intervals of five heating elements from the fourth heating element HD (heating element numbers 4, 9, 14, . . . ) at fifth time for driving (current supply order number 5 is given to these heating elements HD in FIG. 2). When the next line is to be printed, the heating elements that have been driven at first time (heating element number 1, 6, 11, . . . ) are driven at first again, and other heating elements HD are driven successively in the same manner as described hereinabove.

In the case that M color ink is printed, a current is supplied to the second heating element HD positioned rightward next to the left end heating element HD and heating elements HD positioned at intervals of five heating elements HD from the second heating element HD (heating element numbers 2, 7, 12, . . . ) at first time for driving (current supply order number 1 is given to these heating elements HD in FIG. 2), and a current is supplied to the fourth heating element HD positioned at the fourth position from the left end in the right direction and heating elements HD positioned at intervals of five heating elements HD from the fourth heating element HD (heating element numbers 4, 9, 14, . . . ) at second time for driving (current supply order number 2 is given to these heating elements HD in FIG. 2). A current is supplied to the heating element HD positioned at the left end and heating elements HD positioned at intervals of five heating elements HD from the heating element HD positioned at the left end (heating element numbers 1, 6, 11, 16, . . . ) at third time for driving (current supply order number 3 is given to these heating elements in FIG. 2), and a current is supplied to the heating element HD positioned at the third position from the left end in the right direction and heating elements HD positioned at intervals of five heating elements from the third heating element HD (heating element numbers 3, 8, 13, . . . ) at fourth time for driving (current supply order number 4 is given to these heating elements HD in FIG. 2). Finally, a current is supplied to the fifth heating element HD positioned at the fifth position from the left end and heating elements HD positioned at intervals of five heating elements HD from the fifth heating element HD (heating element numbers 5, 10, 15, . . . ) at fifth time for driving (current supply order number 5 is given to these heating elements HD in FIG. 2). When the next line is to be printed, the heating elements that have been driven at first time (heating element number 2, 7, 12, . . . ) are driven at first again, and other heating elements HD are driven successively in the same manner as described above.

In the case that Y color ink is printed, a current is supplied to the heating element HD positioned at the third position from the left end in the right direction and heating elements HD positioned at intervals of five heating elements HD from the third heating element HD (heating element numbers 3, 8, 13, . . . ) at first time for driving (current supply order number 1 is given to these heating elements HD in FIG. 2), and a current is supplied to the heating element HD positioned at the fifth position from the left end in the right direction and heating elements HD positioned at intervals of five heating elements HD from the fifth heating element HD (heating element numbers 5, 10, 15, . . . ) at second time for driving (current supply order number 2 is given to these heating elements in FIG. 2). A current is supplied to the heating element HD positioned at the second position from the left end in the right direction and heating elements HD positioned at intervals of five heating elements from the second heating element HD (heating element numbers 2, 7, 12, . . . ) at third time for driving (current supply order number 3 is given to these heating elements HD in FIG. 2), and a current is supplied to the fourth heating element HD positioned at the fourth position from the left end in the right direction and heating elements HD positioned at intervals of five heating elements HD from the fourth heating element HD (heating element numbers 4, 9, 14, . . . ) at fourth time for driving (current supply order number 4 is given to these heating elements HD in FIG. 2). Finally, a current is supplied to the first heating element HD positioned at the left end and heating elements HD positioned at intervals of five heating elements HD from the heating element HD positioned at the left end (heating element numbers 1, 6, 11, 16, . . . ) at fifth time for driving (current supply order number 5 is given to these heating elements HD in FIG. 2). When the next line is to be printed, the heating elements that have been driven at first time (heating element number 3, 8, 13, . . . ) are driven at first again, and other heating elements HD are driven successively in the same manner as described above.

Figure 3:
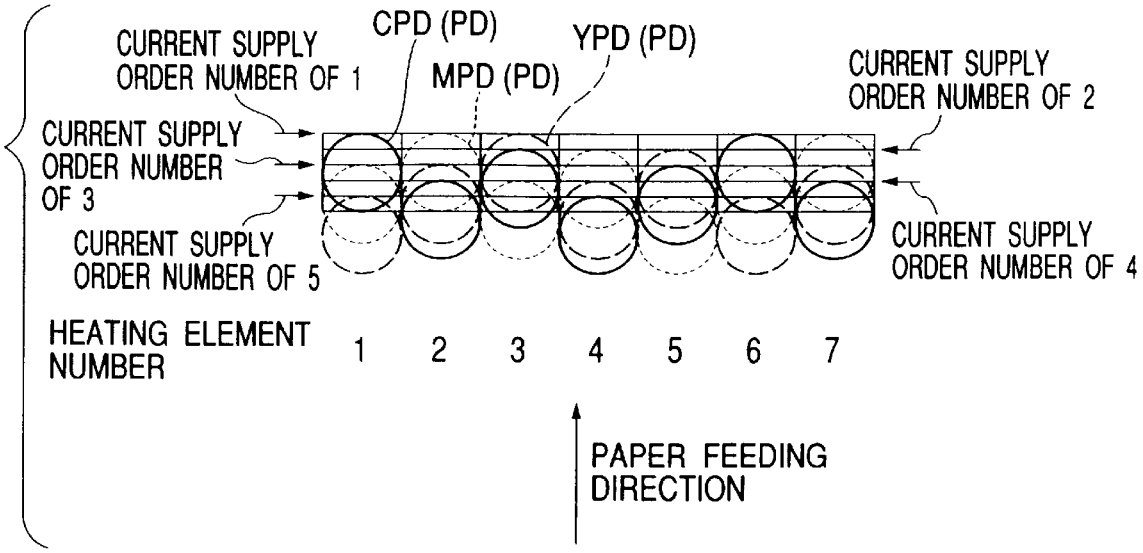
FIG. 3 is an explanatory diagram for describing the printing position of printing dots of each color based on the current supply control method used for a line thermal head in accordance with the present invention.
Figure 4:
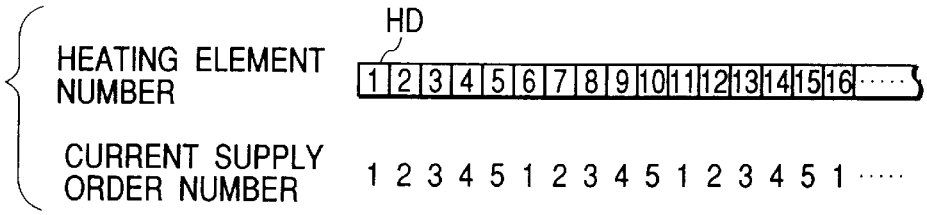
FIG. 4 PRIOR ART
FIG. 4 is an explanatory diagram for describing the driving order of heating elements based on the conventional current supply control method used for a line thermal head.
Figure 5:
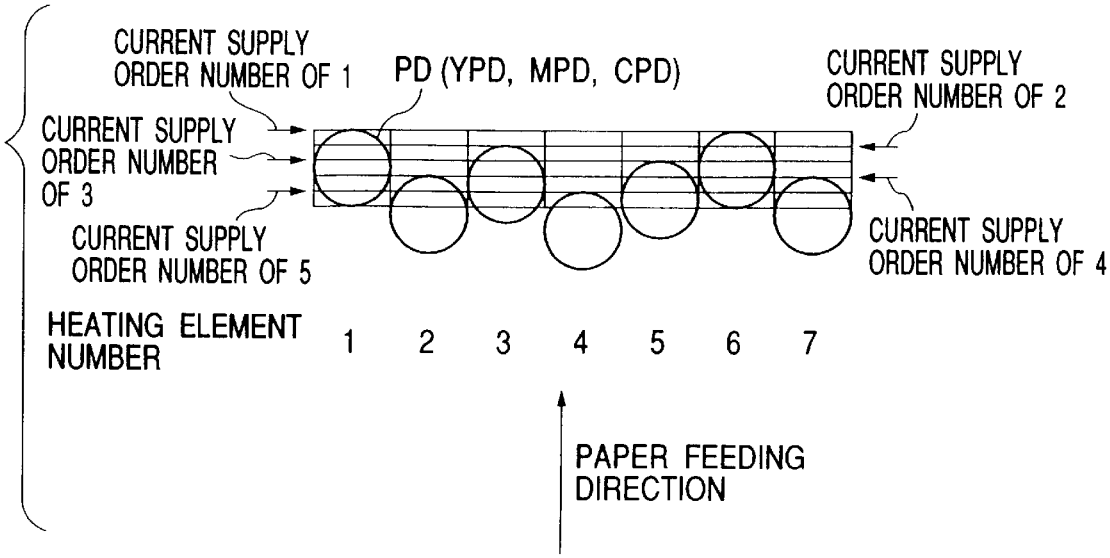
FIG. 5 PRIOR ART
FIG. 5 is an explanatory diagram for describing the printing position of printing dots of each color based on the conventional current supply control method used for a line thermal head.

In the case of printing by means of current supply control as described above, as shown in FIG. 3, the head position of the respective printing dots PD of the current supply order numbers 1, 2, 3, 4, and 5 is positioned in parallel to the line direction and deviates by ⅕ one printing dot PD every current supply order number, and the printing position of the respective color printing dots YPD, MPD, and CPD deviates at most ⅘ dot if there is no deviation of the paper position.

Therefore, for example, in the case that the 300 dip line thermal head 13 is used, because the respective color printing dots YPD, MPD, and CPD are positioned with deviation of about 30 $\mu$m in the paper moving direction, even if the position of the paper deviates by about 5 $\mu$m, the irregular color and jitter due to tending of the whole hue to the color served for printing when the paper position deviates is made unremarkable. In other words, the adverse effect of positional deviation of a paper is mitigated.

According to the thermal transfer line printer P to which the current supply control method used for a line thermal head 13 of the present invention, each heating element is served for printing correspondingly to the number of divisions, and because the printing position of respective-color printing dots YPD, MPD, and CPD is formed at the position with deviation, the irregular color and jitter due to deviation of paper feeding position are made unremarkable. Therefore, the adverse effect of deviation of paper feeding position is mitigated, and the irregular color and jitter due to paper feeding accuracy is reduced easily.

The odd number of divisions is preferable for easily reducing irregular color and jitter due to the paper feeding accuracy, and it is ensured by evaluation test of printing quality that the number of divisions of 5 is particularly preferable for easily reducing irregular color and jitter due to the paper feeding accuracy because the adverse effect of deviation of the paper feeding position is mitigated.

The odd number of divisions, particularly 5, is preferable for balancing the relation between the power consumption and printing speed in the case a power source of low capacity is used as in the case of battery driving.

The present invention is by no means limited to the above-mentioned embodiment, but various modifications may be applied as required.

As described hereinbefore, according to the: current supply control method used for a line thermal head of the present invention, the adverse effect of deviation of the paper feeding position is mitigated, and the irregular color and jitter due to the paper feeding accuracy is reduced easily, thus the present invention brings about very excellent effect.

The number of divisions that is preferable for easily reducing the irregular color and jitter due to the paper feeding accuracy is obtained by using an odd number of divisions for the divided driving.

The number of divisions that is preferable for easily reducing the irregular color and jitter due to the paper feeding accuracy is obtained by using the number of divisions for the divided driving of 5.

What is claimed is:

1. A current supply control method used for a line thermal head in which a current is supplied to a plurality of heating elements of a line thermal head dividedly into a plurality of times with intervals of several heating elements for divided driving while a color ink film and a paper are being fed and each heating element is heated selectively to thereby transfer inks of at least three primary colors on the color ink film onto the paper for color printing, wherein heating elements served for divided driving are controlled so as to be different for each color served for printing.

2. The current supply control method used for a line thermal head according to claim 1, wherein the number of divisions for the divided driving is an odd number.

3. The current supply control method used for a line thermal head according to claim 2, wherein the number of divisions for the divided driving is 5.

* * * * *